US010174766B2

(12) United States Patent
Thornton

(10) Patent No.: US 10,174,766 B2
(45) Date of Patent: Jan. 8, 2019

(54) DIFFUSER FOR A FORWARD-SWEPT TANGENTIAL FLOW COMPRESSOR

(71) Applicant: Dynamic Boosting Systems Limited, Kingston Upon Thames (GB)

(72) Inventor: Warren Thornton, Flitwick (GB)

(73) Assignee: Dynamic Boosting Systems Limited, Kingston Upon Thames (GB)

( * ) Notice: Subject to any disclaimer, the term of this patent is extended or adjusted under 35 U.S.C. 154(b) by 365 days.

(21) Appl. No.: 14/912,527

(22) PCT Filed: Jul. 30, 2014

(86) PCT No.: PCT/GB2014/052335

§ 371 (c)(1),
(2) Date: Feb. 17, 2016

(87) PCT Pub. No.: WO2015/025132

PCT Pub. Date: Feb. 26, 2015

(65) Prior Publication Data

US 2016/0195107 A1 Jul. 7, 2016

(30) Foreign Application Priority Data

Aug. 19, 2013 (GB) ..... 1314770.7

(51) Int. Cl.
*F04D 29/44* (2006.01)
*F04D 29/30* (2006.01)
(Continued)

(52) U.S. Cl.
CPC ..... *F04D 29/444* (2013.01); *F04D 17/10* (2013.01); *F04D 29/284* (2013.01); *F04D 29/30* (2013.01);
(Continued)

(58) Field of Classification Search
CPC ..... F04D 29/284; F04D 29/30; F04D 29/444; F05D 2240/121; F05D 2240/122; F05D 2240/30
See application file for complete search history.

(56) References Cited

U.S. PATENT DOCUMENTS 973,782 A 10/1910 Hayton
1,065,731 A 6/1913 Schneible
(Continued)

FOREIGN PATENT DOCUMENTS

JP H8-93694 A 4/1996
JP 2004-339999 A 12/2004
(Continued)

*Primary Examiner* — Ninh H. Nguyen
(74) *Attorney, Agent, or Firm* — Dilworth & Barrese, LLP

(57) ABSTRACT

A diffuser for a forward-swept tangential flow compressor comprises a substantially circular space (24) for receiving a compressor impeller (14), a plurality of micro-volutes (42) adjacent to and surrounding the circular space (24), a plurality of diffuser channels (38), each diffuser channel (38) having an entrance and a discharge, and a collection volute (28), the entrance of each diffuser channel (38) extending from an associated micro-volute (42) tangentially of the circular space (24), and the collection volute (28) transitioning from the discharge of one of the diffuser channels (38), the other diffuser channels discharging into the collection volute (28), and the collection volute (28) incorporating an exit aperture (30).

19 Claims, 5 Drawing Sheets

(51) Int. Cl.
*F04D 29/42* (2006.01)
*F04D 17/10* (2006.01)
*F04D 29/28* (2006.01)

(52) U.S. Cl.
CPC ..... *F04D 29/422* (2013.01); *F04D 29/4233* (2013.01); *F04D 29/441* (2013.01); *F05D 2240/121* (2013.01); *F05D 2240/122* (2013.01); *F05D 2240/30* (2013.01); *F05D 2250/52* (2013.01)

(56) References Cited

U.S. PATENT DOCUMENTS 3,103,177 A * 9/1963 Gatto ..... F04D 9/02 415/186
3,289,922 A * 12/1966 Sawyer ..... F04D 17/122 415/199.2
3,860,360 A 1/1975 Yu
3,904,312 A * 9/1975 Exley ..... F04D 29/44 415/181
3,964,837 A * 6/1976 Exley ..... F04D 29/441 415/181
4,900,225 A * 2/1990 Wulf ..... F04D 29/441 415/207
5,123,811 A * 6/1992 Kuroiwa ..... F04D 17/10 415/170.1
2005/0232762 A1 10/2005 Smoke et al.

FOREIGN PATENT DOCUMENTS

JP 2010-144698 A 7/2010
WO 2005/024242 A1 3/2005
WO WO 2005024242 A1 * 3/2005 ..... F04D 29/284

* cited by examiner

DIFFUSER FOR A FORWARD-SWEPT TANGENTIAL FLOW COMPRESSOR

The present invention relates to a diffuser for a forward-swept tangential flow compressor.

BACKGROUND TO THE INVENTION

It is well known to provide a centrifugal compressor, which operates at high speeds, for use in the transport and energy industries.

Centrifugal compressors offer advantages over positive displacement compressors, such as reciprocating compressors, rotary screw compressors, and rotary vane compressors, in that they have a much higher power density, offer oil-free compression, a low parts count and steady flow delivery.

One shortcoming of centrifugal compressors when compared with positive displacement compressors is that the shaft speed must increase as the flow rate reduces. An increased shaft speed will result in increased wear and tear on bearings, reducing the life of the compressor. Centrifugal compressors also generally exhibit low efficiency at low flow rates. For these reasons, positive displacement compressors have been the primary method by which low flow rate applications have been managed thus far, with their disadvantages of noisy operation and high maintenance costs.

Some existing centrifugal compressors run at 60,000 to 250,000 rpm in order to provide the required performance.

Centrifugal compressors have rotors which are either forward-swept or backward-swept. A forward-swept design, in which the rotors have blades that are curved towards the direction of flow, is beneficial because there is no need to increase the static pressure in the rotor, which solves various problems which can otherwise result from a pressure gradient between the rotor inlet and outlet. A centrifugal compressor rotor with an exaggerated forward-sweep, between 20 and 90 degrees to a radius of the compressor, is particularly useful because the speed of the fluid at the rotor exit is greater than the blade speed, providing for a large pressure rise from a relatively small compressor, i.e., a small diameter rotor. A forward-swept tangential (as opposed to radial) centrifugal compressor of this type is disclosed in WO2005024242. However, forward-swept compressors are known to be inherently unstable.

It is an object of the invention to provide an improved diffuser for a centrifugal compressor, allowing more stable operation at low flow rates without excessive shaft speed.

STATEMENT OF INVENTION

According to a first aspect of the present invention, there is provided a diffuser for a forward-swept tangential flow compressor, the diffuser comprising a substantially circular space for receiving a compressor impeller, a plurality of micro-volutes adjacent to and surrounding the circular space, a plurality of diffuser channels, each diffuser channel having an entrance and a discharge, and a collection volute, the entrance of each diffuser channel extending from an associated micro-volute tangentially of the circular space, and the collection volute transitioning from the discharge of one of the diffuser channels, the other diffuser channels discharging into the collection volute, and the collection volute incorporating an exit aperture. A micro volute is similar to a full volute but instead of substantially encompassing a full azimuth angle of 360°, a number of micro volutes added together will substantially encompass this angle. By way of example, 6 micro volutes each occupying 60° azimuth angle will encompass the full azimuth angle of 360°

The diffuser may be used with a highly forward-swept impeller, for example of the type disclosed in WO2005024242, the description of which is incorporated herein by reference. In particular, the forward sweep of the impeller may be increased to the point where the fluid flow expelled from the impeller exit is substantially tangential to the impeller. That is, the diffuser is for use in a tangential, rather than a radial, compressor. Together with the array of micro-volutes between the impeller and the diffuser, this provides a compressor which is stable over a reasonable flow range.

The diffuser is optimised for use in a tangential flow compressor. The micro-volutes may be integral with the entrances to the diffuser channels, and are aligned with the direction of flow from the impeller, to avoid blockage which would potentially cause a compressor stall.

The collection volute substantially surrounds the diffuser, and transitions from one of the diffuser channels. In other words, the collection volute is formed integrally with the diffuser channel, forming a substantially continuous fluid passage from the impeller, through a micro-volute, through a diffuser channel, and through the collection volute to the exit aperture.

A plurality of vanes may be provided, each vane having a forward face and a rearward face, the forward and rearward faces of adjacent vanes each defining one of the diffuser channels, and a portion of each forward face defining one of the micro-volutes between the circular space and the vane. That is, the diffuser channels are in the spaces between the vanes.

In other words, a portion of the forward face of each vane may form a wall of one of the micro-volutes, and a further portion of the forward face of each vane may form a diffuser channel together with the rear face of an adjacent vane. In this way, the micro-volute is integral with the diffuser channel, and may be said to form the entrance to the diffuser channel, guiding the substantially tangential flow from the rotor exit into the diffuser channel. As fluid is expelled from the impeller, it will flow through the micro-volutes between the impeller and the diffuser, and then into the diffuser channels. This provides for optimum acceptance of the expelled fluid into the diffuser.

The width of each micro-volute may be around the same width as the minimum width of each diffuser channel. In other words, the micro-volutes may be closely coupled to the outlet of the impeller so as to form a minimal vaneless space between the impeller and the vanes of the diffuser.

Ordinarily, a narrow vaneless space will cause excessive blockage in a radial compressor, as there is nowhere for the fluid to escape to. However, in the case of a tangential flow compressor, the fluid has a minimal radial component, and can be easily accepted into the entrances of the diffuser channels if they form micro-volutes.

The closely-coupled micro-volutes keep the compressor stable, since they impede flow reversal which could otherwise lead to stalling in a design with a wide vaneless space. For successful operation with close-coupled micro-volutes, a highly forward-swept impeller with substantially tangential fluid flow at the exit is required. An impeller which is only moderately forward-swept used with a diffuser having closely-couple micro-volutes would lead to excessive blockage in the diffuser.

The diffuser channels may be divergent in the tangential-radial plane. In other words, the diffuser channels have a cross-sectional area which increases from the entrance to the discharge. Each diffuser channel may be curved to converge smoothly with the micro-volute at its entrance and with the collection volute at its discharge. That is, the diffuser channels may curve in the direction of rotation of the impeller.

The diffuser channels may be divergent only in the tangential-radial plane (a "two-dimensional diffuser") or alternatively may diverge also in the axial-radial plane (a "three-dimensional diffuser"). Diffusion is more efficient with three dimensional diffusion channels.

Divergent diffuser channels allow for increased efficiency of diffusion of fluid from the impeller, improving the recovery of kinetic energy in the diffuser, and hence improving the useable static pressure rise. The forward sweep at the end of each diffuser channel ensures a smooth flow convergence into the collection volute, preventing blockage of the diffuser.

The diffuser may be manufactured in two injection mouldable halves, which may be split about the radial-tangential plane. Individually moulded halves allow for the divergent channels to be shaped easily in manufacturing. This is particularly so for the three-dimensional diffuser.

The diffuser channels may have a rectangular cross-section, or alternatively the walls of the channels may have chamfered or radiussed/filleted internal edges. Such edges are found to optimise fluid flow within the diffuser and to improve performance, and are particularly suitable for a compressor manufactured by injection-moulding. Surface finish is found to be important for performance, and injection-moulding is a suitable technique for producing a diffuser with an excellent finish, and with the above described desirable geometric characteristics.

According to a second aspect of the invention, there is provided a forward-swept tangential flow compressor comprising an impeller and a diffuser, the impeller having a plurality of forward-swept rotor blades and being disposed in a substantially circular space within the diffuser, and the diffuser including a plurality of micro-volutes adjacent to and surrounding the impeller, a plurality of diffuser channels, each diffuser channel having an entrance and a discharge, and a collection volute, the entrance of each diffuser channel extending from an associated micro-volute tangentially of the impeller, and the collection volute transitioning from the discharge of one of the diffuser channels, the other diffuser channels discharging into the collection volute, and the collection volute incorporating an exit aperture.

Preferable and/or optional features of the second aspect of the invention are described herein.

DESCRIPTION OF THE DRAWINGS

For a better understanding of the present invention, and to show more clearly how it may be carried into effect, reference will now be made by way of example only to the accompanying drawings, in which.

DESCRIPTION OF PREFERRED EMBODIMENT

Figure 1:
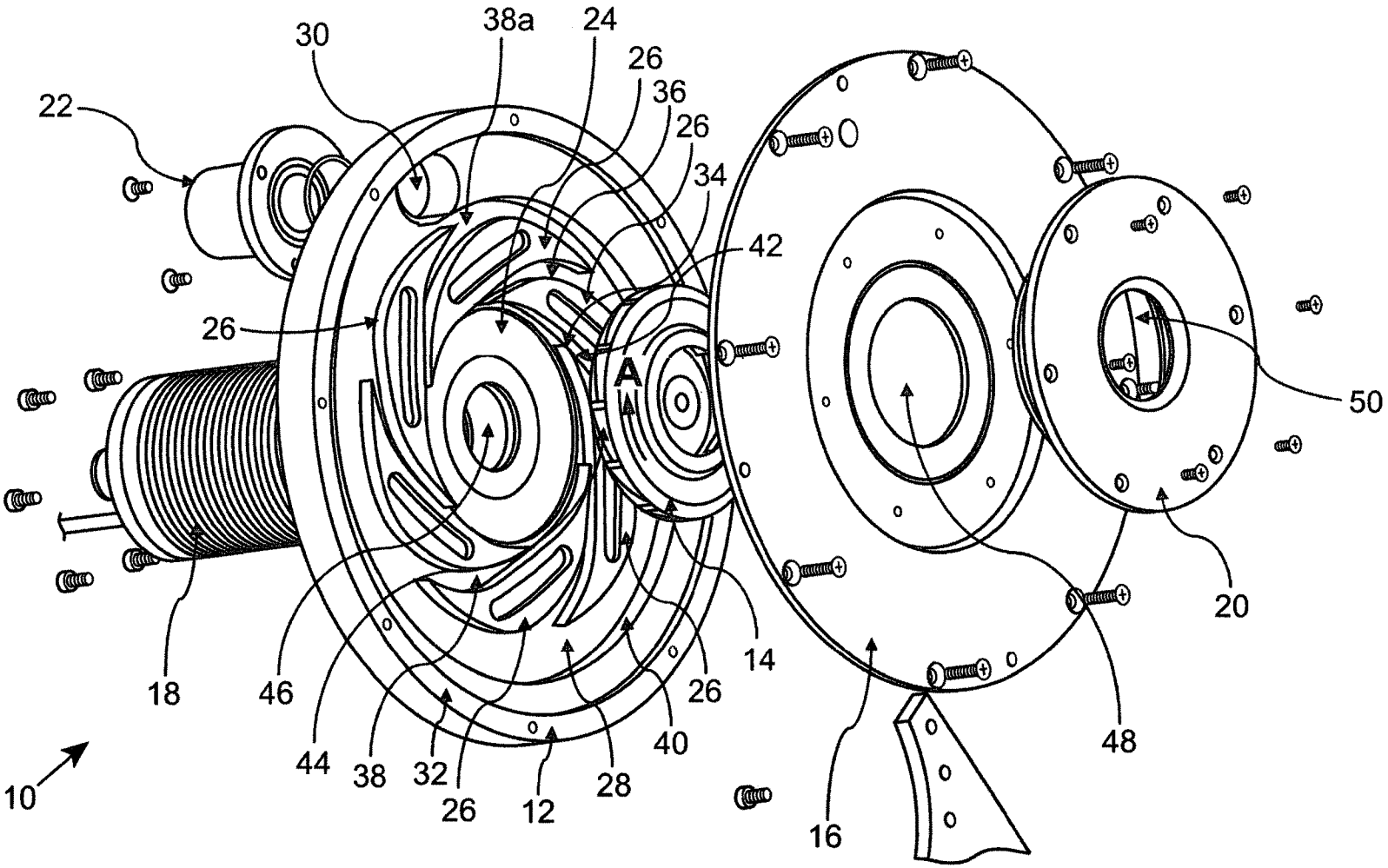
FIG. 1 shows a perspective view of a first embodiment of a tangential flow compressor according to the invention, including a two-dimensional diffuser and an impeller.

Referring firstly to FIG. 1, a centrifugal compressor is indicated generally at 10. The compressor 10 comprises a main casing 12, an impeller 14, a cover plate 16, a motor 18, a secondary cover plate 20 and an outlet assembly 22.

The main casing 12 provides a diffuser for the compressor 10, and as such includes a substantially circular space 24 for receiving the impeller 14, a plurality of diffuser vanes 26 surrounding the circular space 24, a collection volute 28 surrounding the vanes 26, and an outlet aperture 30. An outer wall 32 surrounds the collection volute and, with the cover plate 16, encloses the aforementioned parts of the diffuser.

In use, the impeller 14 sits within the circular space 24, and is driven by the motor 18 in the direction of arrow A.

The diffuser includes six vanes 26 in total, and the arrangement of vanes is rotationally symmetrical about the axis of rotation of the impeller 14. That is, each vane 26 is identical to the next, and the vanes are angular translations of each other about the axis of rotation of the impeller 14. The vanes 26 each include a forwardly-facing wall 34 and a rearwardly-facing wall 36. The walls 34, 36 of the vane are both curved in the direction of rotation A, and form a vane with an irregular crescent-like shape.

The vanes define diffuser passages 38, each diffuser passage 38 being bounded by the forwardly-facing wall 34 of one vane 26, and the rearwardly-facing wall 36 of an adjacent vane 26. The diffuser passages 38 are curved in the direction of rotation, and grow wider as they move outwardly, i.e. away from the impeller.

The collection volute 28 is bounded by the vanes 26 and by an internal wall 40. The collection volute 28 transitions from one of the diffuser passages 38*a*, the remaining diffuser passages 38 discharging into the collection volute 28 around the circumference of the diffuser. The curvature of the diffuser passages 38 ensures a smooth discharge into the collection volute. As the collection volute 28 extends around the circumference of the diffuser from diffuser passage 38*a*, past the other diffusers, and to the outlet 30, the collection volute 28 grows wider. Internal wall 40, which defines the outer boundary of the collection volute 28, is in substantially the shape of a spiral.

The vanes 26 also define micro-volutes 42 adjacent the impeller 14. The micro-volutes 42 transition into the entrances to the diffuser channels 38. The micro-volutes 42 are close-coupled to the impeller 14, that is, they are narrow. In other words, there is a minimal vaneless space between the impeller 14 and the vanes 26. The entrances to the diffuser channels 38 are substantially tangential of the impeller, and the micro-volutes 42 guide flow into the diffuser channels 38.

The impeller 14 includes blades 44 which are highly forward-swept. Each blade is substantially tangentially oriented at its tip and the flow out of the impeller is in a substantially tangential direction. Together with the closely-coupled micro-volutes 42 and forward-swept diffuser channels 38, this allows for efficient and stable operation at low flow rates and low shaft speeds. For example, this embodiment may operate at between 15,000 and 20,000 rpm, to obtain similar performance to a prior art compressor operating at between 60,000 and 100,000 rpm.

The motor 18 or any other rotational drive is introduced into the main casing through an aperture 46 at the centre of the circular space 24. The motor 18 drives the impeller. The cover plate 16 fits over the main casing 12, enclosing the impeller 14 within the main casing 12. The cover plate 16 is secured to the outer wall 32 of the casing 12 by screws.

The cover plate 16 includes an aperture 48 at its centre. The secondary cover plate 20, also with an aperture 50 at its centre, fits over the cover plate 16 and forms an inlet assembly. In use, gas is drawn into the compressor at the centre of the impeller 14, via apertures 48, 50. The gas is accelerated via the impeller and is expelled into the diffuser substantially tangentially. The gas then passes through the diffuser channels 38 and collection volute 28, where the velocity of the gas is reduced and the static pressure is increased. Gas with increased static pressure is expelled from the outlet 30.

Figure 2:
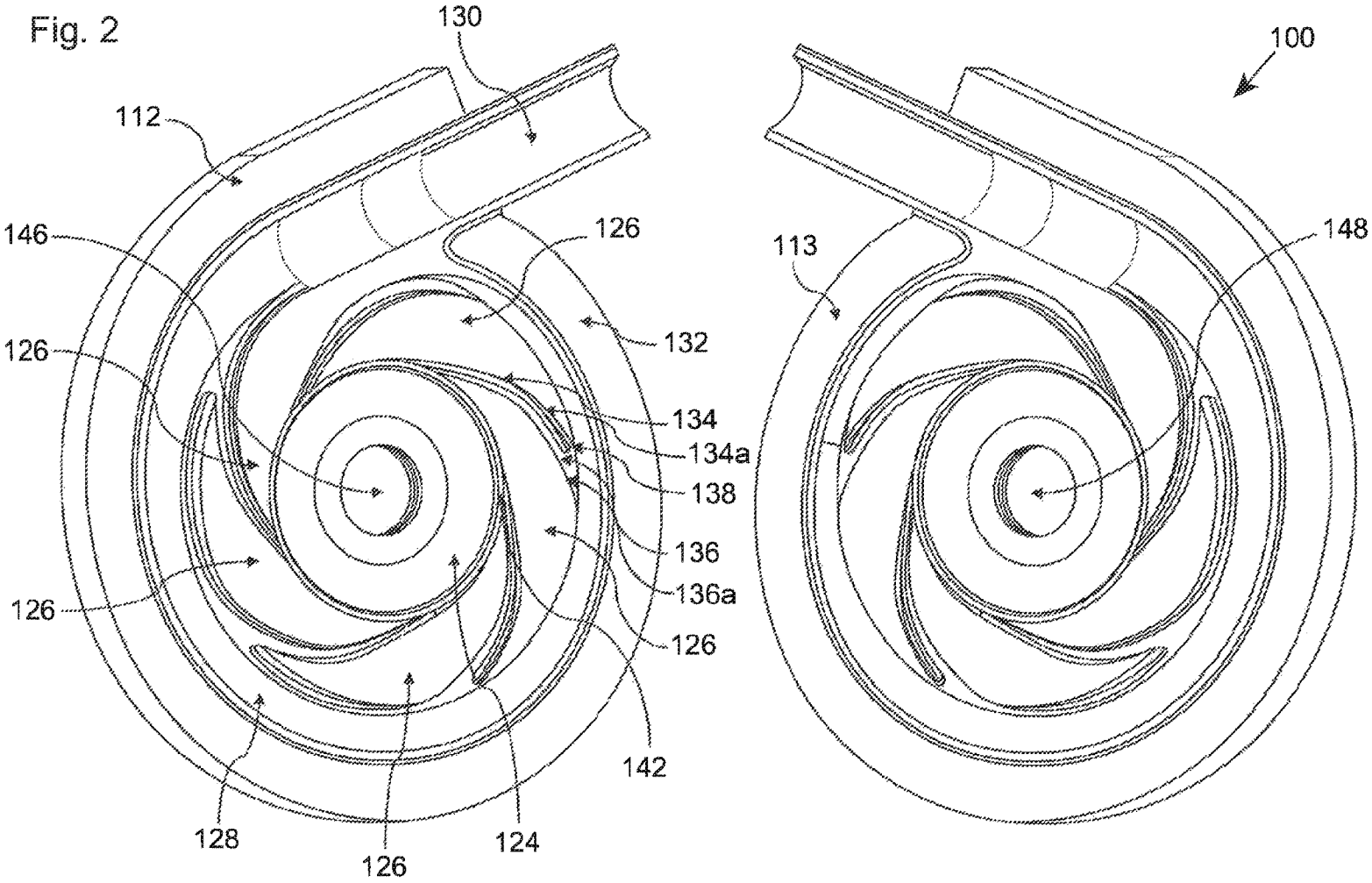
FIG. 2 shows a perspective view of a second embodiment of a diffuser, in this case a three-dimensional diffuser, for a tangential flow compressor.

Referring now to FIG. 2, a second embodiment of a diffuser for a compressor is indicated generally at 100. The diffuser is in many respects similar to the diffuser of FIG. 1, and includes a two-part casing 112, 113 having a substantially circular space 124 for receiving an impeller, a plurality of diffuser vanes 126, a collection volute 128, an outlet 130, and an outer wall 132. Each vane 126 has a forward-facing wall 134 and a rearward-facing wall 136, and the vanes 126 define diffuser channels 138 between the forward-facing wall 134 of one vane 126 and the rearward-facing wall 136 of an adjacent vane. A portion of each forward-facing wall 134 bounds a micro-volute 142 adjacent the impeller.

In this embodiment, the outlet 130 expels gas tangentially of the diffuser, through an outlet which is an extension of the collection volute 128.

The walls 134, 136 of the vanes 126 have chamfered edges 134*a*, 136*a*. As a result, the diffuser channels 138 are divergent in the axial-radial plane as well as the radial-tangential plane. In other words, this is a three-dimensional diffuser.

An aperture 146 is provided at the centre of the diffuser on one side, and a further aperture 148 is provided in the centre of the diffuser on the other side. In use, a motor or other rotary drive drives the impeller through the aperture 146, and aperture 148 provides the gas inlet to the compressor.

Figure 3:
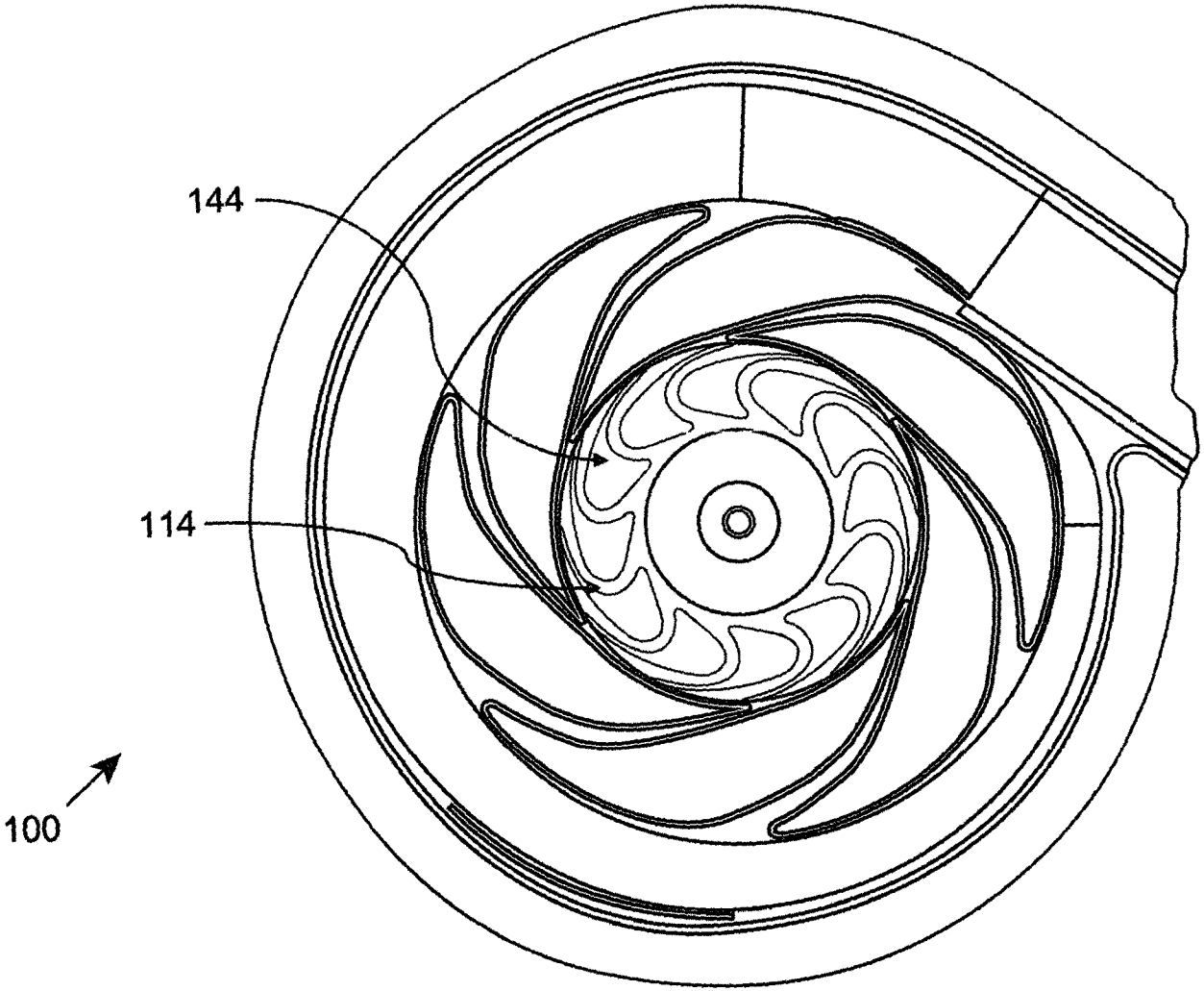
FIG. 3 shows a plan view of a compressor comprising the diffuser of FIG. 2, and an impeller.

FIG. 3 shows a plan view of one half of the diffuser 100, with an impeller 114 installed. The impeller has highly forward-swept blades 144, as described above.

The two halves of the diffuser, as shown in FIG. 2, fit over each other to enclose the impeller. They may be joined by adhesive, welding, bolts, or any other suitable fastening, depending on the particular application and the material of the specific diffuser.

Figure 4:
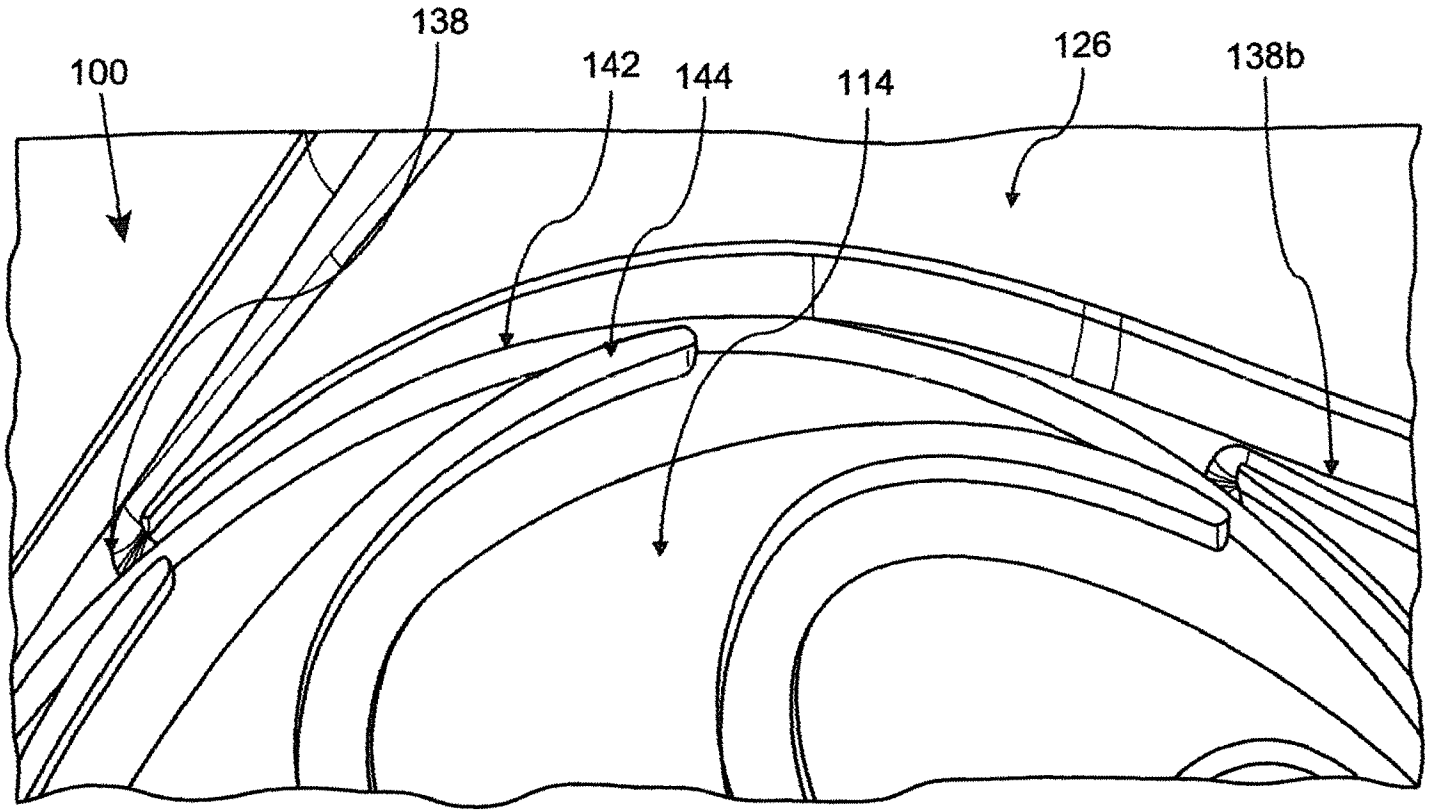
FIG. 4 shows a close-up perspective view of part of the compressor of FIG. 3.

FIG. 4 shows a close-up perspective view of diffuser 100, with the impeller 114 installed. The interface between the impeller 114 and the vanes 126 is shown. Parts of two diffuser channels 138 are shown in the Figure, and a micro-volute 142 is seen forming an entry to one of the diffuser channels 138*b*. The vaneless space which forms the micro-volute is narrow.

As seen in the Figure, the highly forward-swept blades 144 of the impeller 114 expel gas from the impeller substantially tangentially. The expelled gas then passes into the diffuser channels 138 via the micro-volutes 142.

Figure 5:
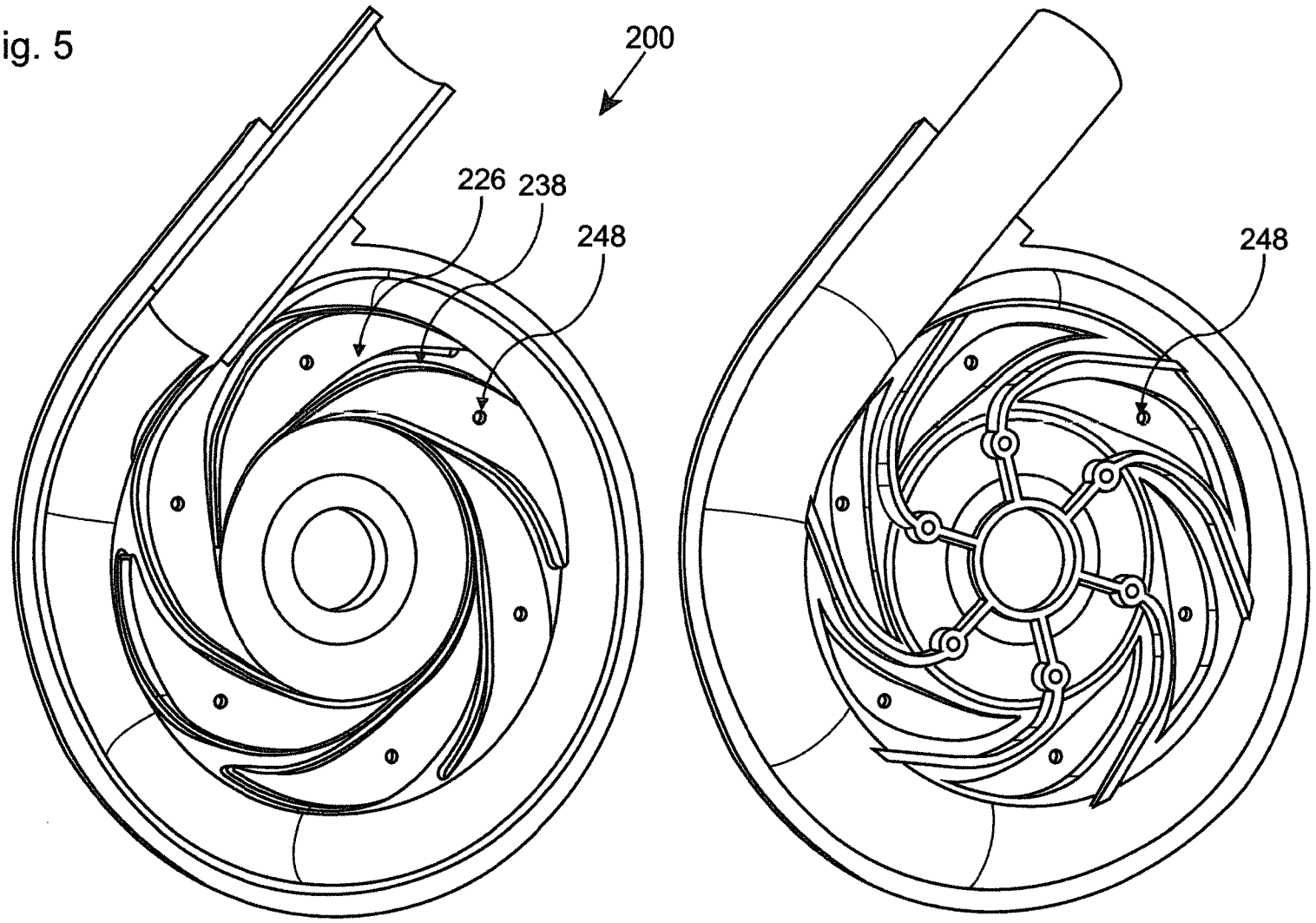
FIG. 5 shows a perspective view of a third embodiment of a diffuser for a tangential flow compressor.

FIG. 5 shows a third embodiment 200 of a three-dimensional diffuser for a compressor. This embodiment is substantially identical to the second embodiment 100 in terms of its working parts, but includes design features which make it suitable for production as a two-piece injection-moulded unit. Note that, in the Figure, the interior of the left-hand half and the exterior of the right-hand half are visible. Bolt holes 248 are provided for fixing the two halves together. The bolt holes are positioned substantially centrally of each vane 226, to ensure that a good seal is formed on each vane, minimising any leakage from the diffuser channels 238.

The embodiments described above are provided by way of example only, and various changes and modifications will be apparent to persons skilled in the art without departing from the scope of the present invention as defined by the appended claims. In particular, the specific number of vanes disclosed in each embodiment should be taken as one working example only.

The invention claimed is:

1. A diffuser for a forward-swept tangential flow compressor, the diffuser comprising a substantially circular space for receiving a compressor impeller, a plurality of micro-volutes adjacent to and surrounding the circular space, a plurality of diffuser channels, the width of each micro-volute is substantially the same width as the minimum width of each diffuser channel, each diffuser channel having an entrance and a discharge, and a collection volute, the entrance of each diffuser channel extending from an associated micro-volute tangentially of the circular space, and the collection volute transitioning from the discharge of one of the diffuser channels, the other diffuser channels discharging into the collection volute, and the collection volute incorporating an exit aperture, the diffuser channels being divergent in the tangential-radial plane and also divergent in the axial-radial plane.

2. A diffuser as claimed in claim 1, in which a plurality of vanes are provided, each vane having a forward face and a rearward face, the forward and rearward faces of adjacent vanes each defining one of the diffuser channels, and a portion of each forward face defining one of the micro-volutes between the circular space and the vane.

3. A diffuser as claimed in claim 1, in which each diffuser channel is curved to converge smoothly with the micro-volute at its entrance and with the collection volute at its discharge.

4. A diffuser as claimed in claim 1, in which the diffuser is manufactured in two injection-moulded halves.

5. A diffuser as claimed in claim 4, in which the diffuser is split into two halves about the radial-tangential plane.

6. A diffuser as claimed in claim 1, in which the diffuser channels have a rectangular cross-section.

7. A diffuser as claimed in claim 1, in which the walls of the diffuser channels have chamfered internal edges.

8. A forward-swept tangential flow compressor comprising an impeller and a diffuser, the impeller having a plurality of forward-swept rotor blades and being disposed in a substantially circular space within the diffuser, and the diffuser including a plurality of micro-volutes adjacent to and surrounding the impeller, a plurality of diffuser channels, the width of each micro-volute is around the same width as the minimum width of each diffuser channel, each diffuser channel having an entrance and a discharge, and a collection volute, the entrance of each diffuser channel extending from an associated micro-volute tangentially of the impeller, and the collection volute transitioning from the discharge of one of the diffuser channels, the other diffuser channels discharging into the collection volute, and the collection volute incorporating an exit aperture, the diffuser channels being divergent in the tangential-radial plane and also divergent in the axial-radial plane.

9. A compressor as claimed in claim 8, in which the diffuser includes a plurality of vanes, each vane having a forward face and a rearward face, the forward and rearward faces of adjacent vanes each defining one of the diffuser channels, and a portion of each forward face defining one of the micro-volutes between the impeller and the vane.

10. A compressor as claimed in claim 8, in which each diffuser channel is curved to converge smoothly with the micro-volute at its entrance and with the collection volute at its discharge.

11. A compressor as claimed in claim 8, in which the diffuser is manufactured in two injection-moulded halves.

12. A compressor as claimed in claim 11, in which the diffuser is split into two halves about the radial-tangential plane.

13. A compressor as claimed in claim 8, in which the walls of the diffuser channels have a rectangular cross-section.

14. A compressor as claimed in claim 8, in which the walls of the diffuser channels have chamfered internal edges.

15. A diffuser for a forward-swept tangential flow compressor, the diffuser comprising a substantially circular space for receiving a compressor impeller, a plurality of micro-volutes adjacent to and surrounding the circular space, a plurality of diffuser channels, the width of each micro-volute is around the same width as the minimum width of each diffuser channel, each diffuser channel having an entrance and a discharge, and a collection volute, the entrance of each diffuser channel extending from an associated micro-volute tangentially of the circular space, and the collection volute transitioning from the discharge of one of the diffuser channels, the other diffuser channels discharging into the collection volute, and the collection volute incorporating an exit aperture.

16. A diffuser as claimed in 15, in combination with an impeller, the impeller having a plurality of forward-swept rotor blades and being disposed in a substantially circular space within the diffuser.

17. A diffuser as claimed in claim 15, in which a plurality of vanes are provided, each vane having a forward face and a rearward face, the forward and rearward faces of adjacent vanes each defining one of the diffuser channels, and a portion of each forward face defining one of the micro-volutes between the circular space and the vane.

18. A forward-swept tangential flow compressor comprising an impeller and a diffuser, the impeller having a plurality of forward-swept rotor blades for flow to exit in a substantially tangential direction from the impeller, the impeller being disposed in a substantially circular space within the diffuser, and the diffuser including a plurality of diffuser channels, each diffuser channel having an entrance and a discharge and each diffuser channel being divergent in the tangential-radial plane and also divergent in the axial-radial plane, and the diffuser channels curving in the same direction as the rotor blades;

a plurality of vanes arranged around the impeller, each vane having a forward face and a rearward face, the forward and rearward faces of adjacent vanes each defining one of the diffuser channels, and a portion of each forward face curving around a side of the impeller for minimizing vaneless space;

a plurality of micro-volutes adjacent to and surrounding the impeller, and spaced around the impeller by the vanes, each micro-volute leading from the impeller to the entrance of one of the diffuser channels and being arranged to guide the tangential flow from the impeller into that diffuser channel, wherein a further portion of each forward face defines one of the micro-volutes between the impeller and the respective vane; and a collection volute, the entrance of each diffuser channel extending from an associated micro-volute tangentially of the impeller, and the collection volute transitioning from the discharge of one of the diffuser channels, the other diffuser channels discharging into the collection volute, and the collection volute incorporating an exit aperture.

19. A compressor diffuser as claimed in claim 18, in which the width of each micro-volute is substantially the same width as the minimum width of each diffuser channel.

* * * * *